United States Patent [19]

Sandt et al.

[11] Patent Number: 4,531,538

[45] Date of Patent: Jul. 30, 1985

[54] WATER SUPPLY WINTERIZING SYSTEM

[76] Inventors: David K. Sandt, 316 Cedar La., Montevideo, Minn. 56265; Arthur V. Mitlyng, Jr., Rte. 2, Box 120, Boyd, Minn. 56218; Harold W. Ilaug, Box 468, 816 Town Rd.; Robert D. Quenemoen, Rte. 5, both of Montevideo, Minn. 56265

[21] Appl. No.: 568,823

[22] Filed: Jan. 6, 1984

[51] Int. Cl.[3] ..... E03B 5/00; F16K 37/00

[52] U.S. Cl. ..... 137/334; 137/301; 137/559; 137/566; 137/899; 138/34

[58] Field of Search ..... 137/334, 301, 899, 565, 137/566, 559, 861, 887; 138/34

[56] References Cited

U.S. PATENT DOCUMENTS

| | | | |
|---|---|---|---|
| 2,670,082 | 2/1954 | Dunn et al. | 138/34 |
| 3,873,004 | 3/1975 | Feild | 137/556 |
| 3,893,473 | 7/1975 | Breece | 137/559 |
| 3,929,154 | 12/1975 | Goodwin | 137/301 |
| 4,286,617 | 9/1981 | Bedient | 137/334 |
| 4,298,021 | 11/1981 | Bozeman | 137/334 |

*Primary Examiner*—A. Michael Chambers

*Attorney, Agent, or Firm*—Orrin M. Haugen; Thomas J. Nikolai

[57] ABSTRACT

A system and apparatus operative in a winterizing mode for controllably filling hot and cold water supply lines with anti-freeze to prevent against burst pipes and, in a summerizing mode, for pump recovering the anti-freeze. In one embodiment, the system includes a closed loop, valve containing path having a separate pump, filter and anti-freeze tank. In other alternative embodiments, the water supply tank and a four-way valve are coupled to the closed loop path for switchably operating in the winterizing/summerizing modes, without resorting to a separate pump.

6 Claims, 3 Drawing Figures

WATER SUPPLY WINTERIZING SYSTEM

BACKGROUND OF THE INVENTION

The present invention relates to anti-freeze winterizing systems and, in particular, to a stand-alone system that can be added to a water supply system and whereby the anti-freeze may be recoverably pumped into and out of the water supply lines.

A problem plaguing all owners of self-contained recreational vehicles and leisure homes is that of having to protect the water supply systems from freezing during the cold weather seasons of the year. While one may protect a water supply system by merely draining the system down so as to remove the water that might otherwise freeze and burst the pipes, in practice, this end is not easily achieved, due to the contorted paths through which most water supply systems meander. Because of these paths, pockets of water tend to become trapped within the hot and cold water lines, and thus while the majority of the system may be drained, segregated pockets may still remain and cause the bursting of the water pipes.

Further solutions towards this problem have been to blow the system down with pressurized air or, alternatively, to add anti-freeze to the entire system or at least portions thereof, after partially draining the system. These solutions, however, require a good deal of time and effort in order to ensure that all the branch lines of the supply system are winterized. Still remaining, though, and in spite of the preparations made is the necessity of having to repeat these operations each and every time one might use his or her recreational vehicle or leisure home during the cold weather months. Thus, it is an object of the present invention to provide a stand-alone system that may be added to an existing hot and/or cold water supply system and whereby the water supply system may be automatically winterized/-summerized, while recovering the anti-freeze during each summerizing operation.

Prior attempts at developing automatic winterizing systems can be found upon directing attention to U.S. Pat. Nos. 3,384,123; 3,929,154 and 4,286,617. There, systems are disclosed that admit compressed air or anti-freeze into the water supply lines or utilize the water supply system's pump or a separate pump to pump anti-freeze from a resevoir and fill the hot and cold water lines, exclusive of the holding tank and hot water tank. None of such systems, however, provide for a closed-loop path whereby the anti-freeze may be recovered, with or without filtering after each winterizing operation. The present invention, on the other hand, provides for the recovery of the anti-freeze so that a water supply system may be automatically converted from a winterized to a summerized or a summerized to a winterized condition in a manner of minutes, without the major loss of anit-freeze.

In particular, these ends are achieved with a stand-alone system that in one embodiment includes a separately pumped anti-freeze reservoir and a plurality of flow control valves for controlling the anti-freeze flow. In another system a four-way valve is added to permit similar operation, but without the use of a second pump. A third system, similar to the second, operates much the same. The systems are easily added to any water supply system by appropriately adding a three-way valve at the hot water heater and by coupling the water supply system to a three-way valve at the present winterizing system.

The construction of the present invention, its objects, advantages and distinctions over the prior art will, however, become more apparent upon directing attention to the following description thereof with respect to the following drawings. Before referring thereto, though, it is to be recognized that the present invention is described with respect to its presently preferred embodiment only and that, accordingly, various modifications may be made thereto without departing from the spirit and scope thereof.

SUMMARY OF THE INVENTION

The present invention comprises a system and apparatus for winterizing a water supply system in which a resevoir of anti-freeze, a pump and a plurality of flow control valves in fluid flow communication with the water supply lines are used to controllably and automatically fill the water supply lines with anti-freeze in the fall or to pump the lines down and recover the anti-freeze in the spring. During recovery, the anti-freeze is filtered to remove scale or other undesired matter.

In various alternative embodiments, a four-way valve is coupled to the closed loop control path for permitting winterizing/summerizing operation with a single pump.

DESCRIPTION OF THE PREFERRED EMBODIMENT

Figure 1:
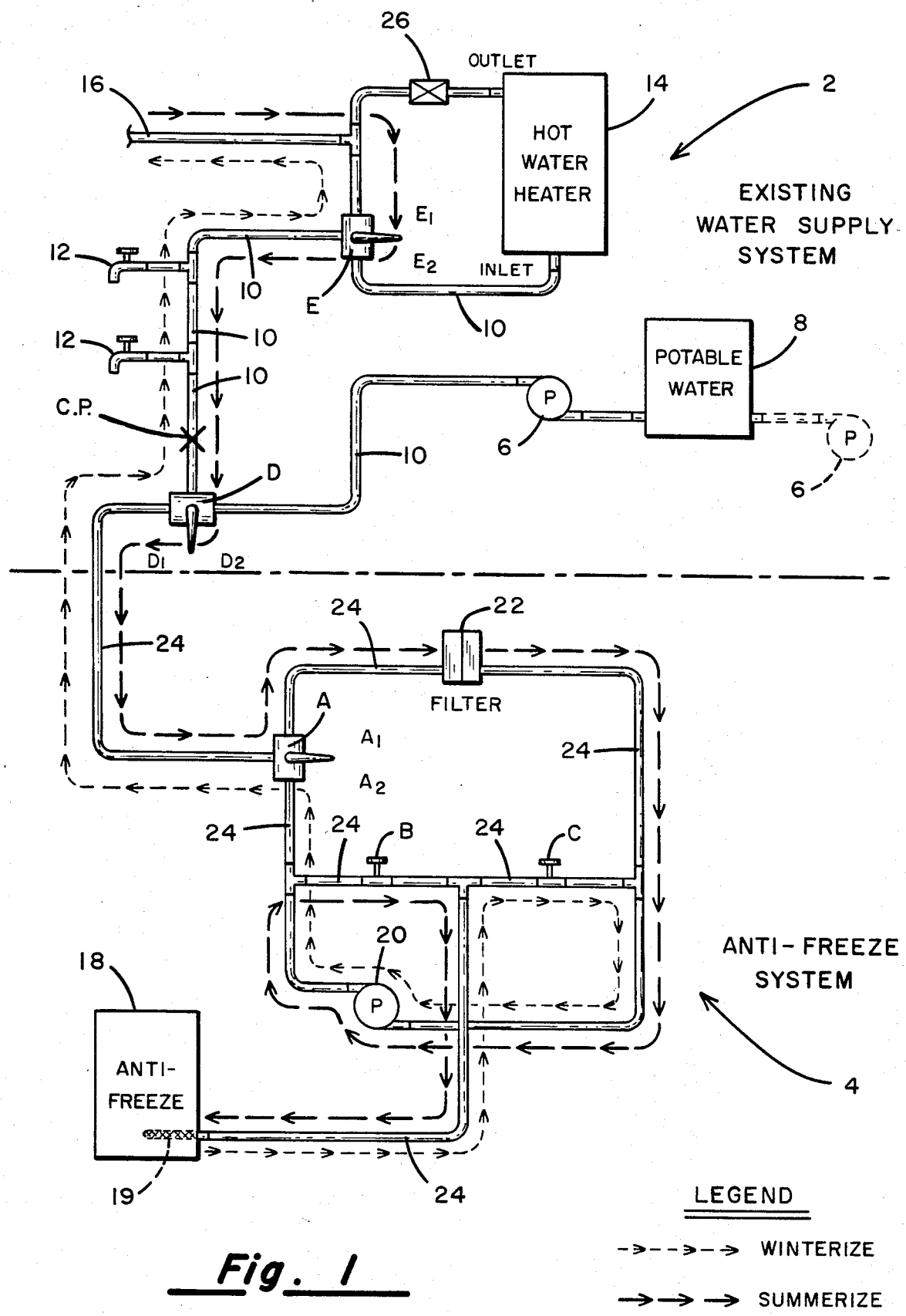
FIG. 1 shows a schematic diagram of the preferred embodiment of a winterizing system relative to an existing water supply system and the winterizing and summerizing flow paths of the anti-freeze.

Referring to FIG. 1, a schematic piping diagram is shown of a water supply system, having the present invention coupled to it. The parts comprising the invention have been separated from the conventional water supply by the line. Specifically, an existing cold/hot water supply system 2, such as is used in a leisure home or recreational vehicle is shown above the dashed line, and the closed loop winterizing/summerizing system of the present invention and identified generally by the call out numeral 4 is shown below the dashed line. Directing attention first to the portion of FIG. 1 showing a typical existing cold/hot water supply system 2, it is to be noted that the system 2 for a recreational vehicle (RV) differs from that for a leisure home, primarily in the placement of the potable water pump 6. Where the pump 6 for a recreational vehicle is typically placed downstream of a potable water supply tank 8; in a permanent structure leisure home with its own well, the pump 6 (shown in dotted line) is typically placed upstream of the water supply tank 8. In either case, though, potable cold water is pumped under pressure and made available to the system 2 via the water pump 6 and tank 8. From the tank 8, pressurized water is supplied through the cold water conduits 10 to a plurality of cold water outlets 12, such as at a kitchen sink, vanity or toilet. The pressurized water is also supplied to the inlet of a hot water heater 14 and from its outlet to the hot water lines 16 that, too, feed the various hot water outlets at the sinks, shower, etcetera that are contained within the water supply system 2.

Because the cold and hot water supply conduits 10 and 16, typically, are physically positioned along a rather convoluted path as they deliver water to the various outlets 12, the system 2 is not easily drained during winterizing by merely opening the outlets 12 and by draining the tanks 8 and 14. In particular, the conduits 10 and 16 tend to trap pockets of water and depending upon their location, these pockets of water may freeze, expand and burst the conduits 10 or 16, during the cold weather off-season, when the water supply system 2 is not used.

Accordingly, the closed-loop system 4 comprising the present invention may be added to the water supply system 2 so that under operater command, it will automatically fill the system 2 with anti-freeze during winterizing and to pump down the system 2 to recover the anti-freeze during the summerizing operation.

With reference to FIG. 1, the present system 4 is seen to comprise an anti-freeze reservoir 18 that is coupled through a filter screen element 19 to a self-contained pump 20 separate from the water supply pump 6, a filter 22 and a plurality of flow control valves A through E that are intercoupled by tubular conduits 24 and the conduits 10 and 16 of the water supply system 2. From FIG. 1, it should also be apparent that in order to convert an existing water supply system 2 to one including the automatic winterizing apparatus of the present invention, it is necessary only to add the three-way control valves D and E in the manner shown. That is, valve D is added near the pump 6 and tank 8 and valve E is added at the hot water heater 14. The present system 4 then couples to the three-way valve D. Thereafter, and depending upon the positions of the three-way valves A, D and E and the two-way gate valves B and C, the flow of hot and cold water and the filling emptying of the conduits 10 and 16 with anti-freeze is accomplished.

Directing attention now to the various flow direction arrows of FIG. 1, the present system 4 will first be described relative to its winterizing mode of operation and then relative to its summerizing mode of operation. As to these modes, it is to be noted that the winterizing mode is shown via the flow path that is marked with short, light arrows, while that for the summerizing mode is shown with longer, bold arrows. Also, before describing the these modes, it is to be recognized that the pump 6 should always be de-energized before starting so that water is not accidentally added to the conduits 10 and 16 during the winterizing/summerizing operations, thereby diluting the anti-freeze.

During winterizing and after disconnecting the pump 6 from its power source, the cold or hot water outlet 12 which is located furthest from the reservoir 18 is opened so as to relieve any pressure in the lines. Thereafter, the present anti-freeze filling system 4 is initiated by positioning the three-way valves D and E to their D2 and E2 positions. Valve D thus couples the anti-freeze in the pipe or conduit 24 to the cold water conduit 10 of the existing water supply system 2, downstream of the potable water tank 8 so as to bypass the tank 8, while vavle E causes the bypassing of the hot water heater 14. The hot water heater 14 and water tank 8 can, at this point, be separately drained by opening their drain spigots, although the drain spigots are not shown they are typically placed at their bottoms so as to permit the draining of any water contained therein. The check valve 26 at the top of the hot water heater 14 precludes anti-freeze entry into the hot water tank through its outlet.

The gate valve B is next closed and the gate valve C is opened, before the pump 20 associated with the anti-freeze distribution system is turned on. Now, when the pump 20 is turned on, anti-freeze is pumped from the tank 18 through the open shut-off valve C, through the pump 20 and vavles A and D to the furthermost removed and open hot or cold water outlet 12. As the anti-freeze is pumped from its holding tank 18, forces any water in the lines 10 and 16 towards the open outlet and fills the cold water supply lines 10 as well as the hot water supply lines 16. The filled condition is indicated by observing the out-flow of colored anti-freeze from the opened outlet 12. To ensure that each branch line is filled with anti-freeze, each of the hot and cold water outlets 12 is thereafter sequentially opened and then closed, once antifreeze is detected.

As to the winterizing of any toilets, this is achieved by flushing the toilet and letting the water flow until anti-freeze enters the water closet, thereafter the toilet can be flushed again so as to place anti-freeze from the water closet into the trap. Alternatively, the anti-freeze may be separatedly added to the bowl to fill the trays. Similarly, sink traps may be removed or the anti-freeze at each outlet 12 can be permitted to run for a time after reaching the outlet 12 so as to fill the sink traps. Once the entire water supply system 2 is filled, the pump 20 is shut off and the winterizing is complete.

Rleative to the winterizing operation, too, a safety feature that may be added, as desired, is that of coupling a pressure switch to the pump 20 so as to ensure that system pressure cannot build up to dangerous levels, which might occur if the operator's attention is diverted during the filling of the lines 10 and 16. A pressure switch would be placed in the electrical supply to shut off the pump 20, if dangerous pressures were approached.

Because of the present invention's unique closed-loop configuration, it is also possible to pump down or "summerize" a previously winterized water supply system 2 and recover the anti-freeze previously pumped into the conduits 10 and 16. In particular, the summerizing of the system 2 is achieved by switching the three-way valve A to its A1 position, while leaving the three-way valves D and E in their D2 and E2 positions. Gate valve B is next opened and gate valve C is closed, before the pump 20 is energized so as to pump the anti-freeze from the conduits 10 and 16. As the anti-freeze is pumped from the water supply system 2, each of the outlets 12 are again opened for a short duration starting at the outlet which is furthermost from the tank 18 and proceeding to the one which is closest so as to ensure the anti-freeze is pumped from each branch hot and cold water line 10 or 16. As the anti-freeze is pumped from the lines, it is to be noted that it is directed via the three-way valve A through a filter 22 having a sight glass, through the pump 20 and opened shutoff valve B and to the anti-freeze tank 18 where it is recollected. Once the anti-freeze is no longer observable in the sight glass at the filter 22, the pump 20 is then shut off. The three-way valves D and E are then also returned to their respective D1 and E1 positions so as to return the water supply system 2 to its normal or summer condition.

The water supply system 2 is now evacuated, except for the anti-freeze contained within the various traps and any which might not have been pumped from the lines 10 or 16. At this point, the water tank 8 is filled from an external source for a RV and otherwise the pump 6 is engaged so as to pressurize the system 2. Each of the hot and cold water outlets 12 are then sequentially opened, moving from the closest to the farthest fixture, until water again flows at each fixture. At this point, the water supply system 2 is again ready for normal use and after which the anti-freeze tank 18 can be checked to determine whether or not anti-freeze should be added before the next winterizing operation.

From the above, it should be apparent that the present anti-freeze winterizing/summerizing system 4 simplifies the otherwise tedious task of switching a water supply system 2 between its winterized and summerized or normal use conditions. Thus, the owner of an RV vehicle or leisure home may now feel free to intermittently use his or her RV or leisure home during the winter months without having to be burdened by the heretofore tedious task of converting the water supply system 2, each time it is used. Also, the present system 4 is particularly advantageous in that only small amounts of anti-freeze are lost with each conversion, therefore, making the conversion much less costly. Still further, the present closed-loop valve arrangement permits the use of a less costly non-reversing pump for the pump 20.

Figure 2:
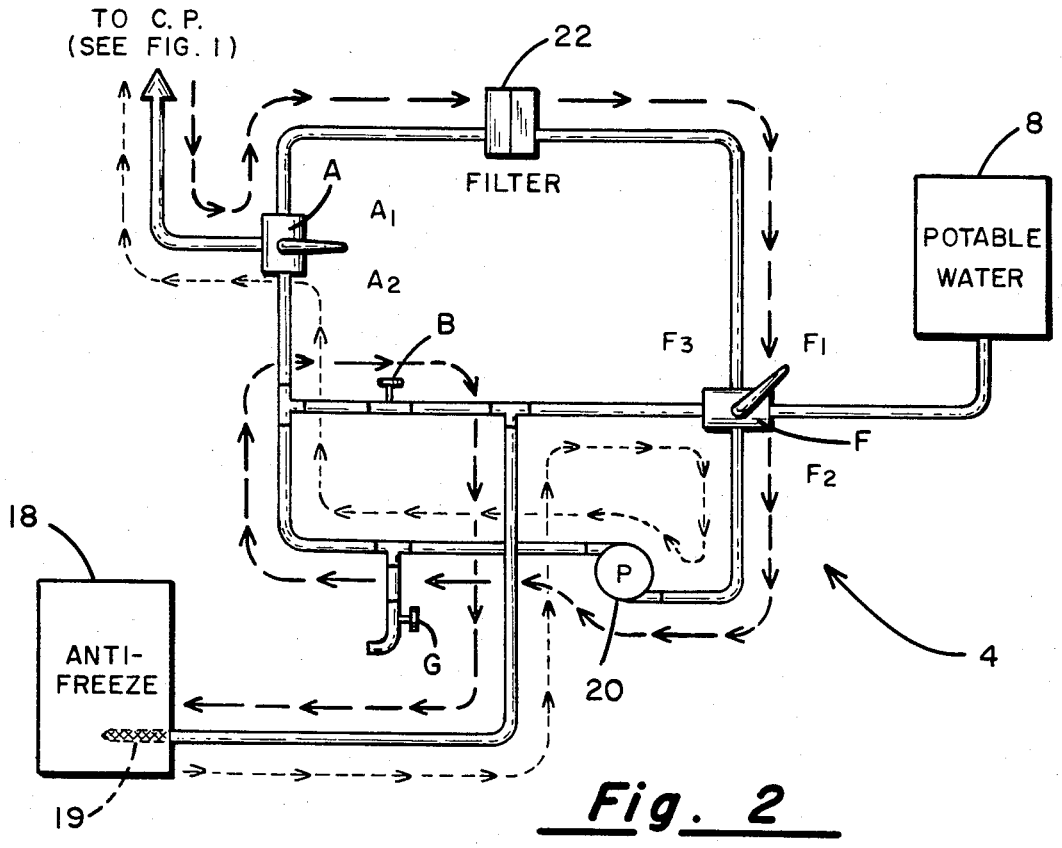
FIG. 2 shows an alternative system wherein a four-way valve in the control path permits operation with a single pump.

Referring now to FIG. 2, an alternative embodiment is shown and wherein the valving is configured so as to remove the need for a separate pump 6. Thus, the winterizing/summerizing system 4 of FIG. 2 is coupled to the water distribution system 2 so as to take advantage of the presence of the pump 20 and utilize it during winterizing/summerizing operations as well as to provide the pressure to distribute the potable water, on call, during the normal use of the recreational home or vehicle. Before discussing the details of FIG. 2, it is also to be noted that with the rearrangement of the valving and the doing away with the pump 6 of FIG. 1 and its connection to valve D, the modified system 4 is to be coupled to the existing water distribution system 2 at the coupling point (CP) shown in FIG. 1 at the dashed line separating the systems 2 and 4.

By combining the winterizing/summerizing system 4 of FIG. 2 at the coupling point (CP) with the existing water supply system 2, it becomes apparent that in addition to the pump 6, the three-way valve D of FIG. 1 is also no longer required, although now a four-way valve F is added to the closed-loop path, along with a drain valve G. The general operation of the system of FIG. 2 is essentially the same as previously described with respect to FIG. 1 and which can be seen via the flow arrows shown adjacent to their respective flow paths during the winterizing and summerizing operations. Specifically, during the winterizing of a water supply system 2 utilizing the system 4 of FIG. 2, the three-way valves A and E are switched to their respective A2 and E2 positions, while the four-way valve F is switched to its F3 position and the shutoff B and drain valve G are closed. Upon energizing the pump 20, the anti-freeze is then pumped from its storage tank 18, through the four-way valve F, through the pump 20, to the valve A and water supply system 2 at the coupling point CP. There the conduits 10 and 16 are again filled in the same manner as previously described, until the system is fully winterized.

During the summerizing operation, the three-way valve A is switched to its A1 position and the four-way valve F to its F1 position and the shutoff B is opened. Upon engaging the pump 20, the anti-freeze is now pumped through the three-way valve A and filter 22 to the four-way valve F, through the pump 20 and shutoff B and back to the storage tank 18. Alternatively, should it not be desired to recollect the anti-freeze 18, such as where the anti-freeze is three or more years old, the drain valve G can be opened and the anti-freeze drained and discarded. Still further, a draindown valve might be added to the anti-freeze storage tank 18, thus removing the need for a drain valve G. Upon draining the conduits 10 and 16, the potable water tank 8 is then returned to the system by switching the four-way valve F to its F2 position, the three-way valve A to its A2 position and the three-way valve E to its E1 position, and after which the water is pumped through the pump 20 and to the hot water conduits 10 and 16 and hot water heater 14. Thus, the system of FIG. 2 essentially performs the same operation as prevously described with respect to FIG. 1 without requiring a separate pump 6 solely to move the potable water through the water lines.

It is also to be noted that by placing valve A in its A1 position and valve F in its F2 position, when two-way valve B is closed and the drain spigot G is opened, the supply of water in the potable water tank can be pumped out.

Figure 3:
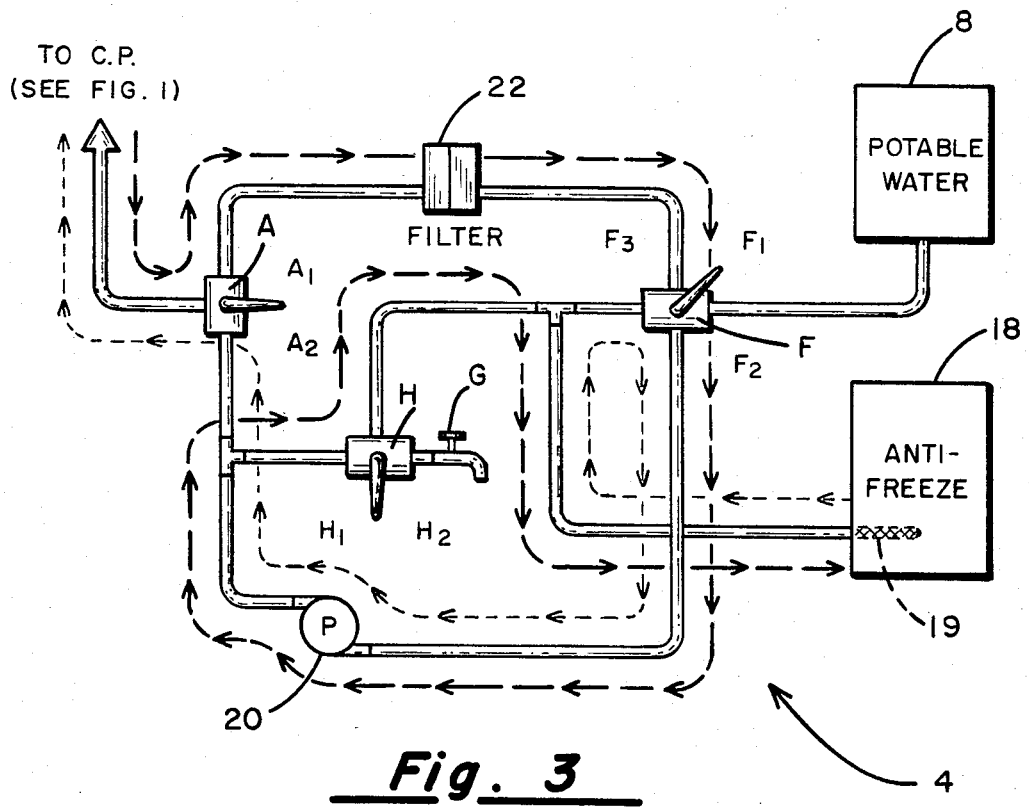
FIG. 3 shows an alternative system of the type of FIG. 2.

Referring now to FIG. 3, yet another alternative embodiment of a winterizing/summerizing system 4 is shown. It is of the same general type as shown in FIG. 2, but again wherein the system components have been slightly rearranged from what is shown in FIGS. 1 and 2. Specifically, a three-way valve H has been added in lieu of the shutoff B and it is directly coupled to the drain valve G. For the system of FIG. 3, the flow paths during the winterizing and summerizing operations are again shown as per the arrow legend of FIG. 1. Specifically, during the winterizing operation, the valves A and E are again switched to their respective A2 and E2 positions, the four-way valve is switched to its F3 position, the three-way valve H is switched to its H2 position and the drain valve G is closed, before the pump 20 is energized. Thereafter, the anti-freeze from the storage tank 18 is pumped through the four-way valve F to the pump 20 and from there through the three-way valve A to the water supply system 2 at the coupling point CP. Again, the system 2's outlets 12 are opened and closed as necessary, until the cold and hot water lines 10 and 16 are filled.

During the summerizing mode of operation, the three-way valve A is switched to its A1 position, the four-way valve F is switched to its F1 position and the three-way valve H is switched to its H1 position, with the drain G closed. Upon actuating the pump 20, the anti-freeze in the hot water lines 10 and 16 is drawn through the three-way valve A, to the filter 22 and from there through the four-way valve F, the pump 20, and back through the three-way valve H to the anti-freeze tank 18. As before, assuming it is not desired to salvage the anti-freeze, the drain valve G may be opened and the three-way valve H switched to its H2 position so as to permit the anti-freeze to drain as waste.

As with the embodiment of FIG. 2, the arrangement of FIG. 3 can be configured to facilitate draining of the potable water tank. Here, if valve A is set to A1, valve F to F2, and valve H to H2, when spigot valve G is opened, the pump 20 can draw water from tank 8 and force it out the drain spigot G. Thus, again, the system of FIG. 3 operates in the same fashion as the embodiments of FIGS. 1 and 2, except again the pump 6 is no longer required, due to the extended operation of the pump 20.

While the present invention has been described with respect to its presently preferred embodiment and a number of alternate embodiments, it is to be recognized that various modifications may be made thereto by those of skill in the art without departing from the spirit and scope thereof. Also, still other embodiments might be suggested with similar closed loop arrangements. It is, accordingly, contemplated that the following claims should be interpreted so as to include those equivalent embodiments within the spirit and scope thereof.

What is claimed is:

1. Apparatus for filling and removing anti-freeze from the water supply conduits of a water supply system having a dedicated pump, comprising in combination:

(a) an anti-freeze containing reservoir;

(b) a second pump;

(c) a first three-way valve coupled in fluid flow relation to said water supply conduits and said anti-freeze reservoir for bypassing a water source and coupling anti-freeze to said water supply conduits in a first position and bypassing said anti-freeze and permitting the flow of water in said water supply conduits in a second position;

(d) a second three-way valve coupled to a hot water suppluy conduit and an inlet and outlet port to a hot water heater for bypassing said hot water heater in a first position and for directing water flow through said water heater in a second position; and (e) a closed-loop fluid flow means coupled in fluid flow relation to said second pump and between said anti-freeze containing reservoir and an anti-freeze supply side of said first three-way valve for supplying anti-freeze to said water supply system in a winterizing mode, or for recoverably pumping said anti-freeze from said water supply system and returning it to said reservoir in a summerizing mode, when said first and second three-way valves are in said first position.

2. Apparatus for first filling and for subsequently removing anti-freeze from the water supply conduits of a water supply system, said water supply system being of the type having its own dedicated pump for distributing potable water through the system, comprising in combination:

(a) an anti-freeze containing reservoir;

(b) a further pump other than said dedicated pump;

(c) filtering means in fluid flow relation to said reservoir for removing foreign matter from said anti-freeze before it enters said reservoir, said filter means having a sight glass for permitting operator viewing of fluid flow;

(d) valve means including a first three-way valve coupled in fluid flow relation to said water supply conduits and said anti-freeze reservoir for bypassing a water source and allowing anti-freeze to flow to said water supply conduits when said first three-way valve is in a first position and bypassing said anti-freeze reservoir and permitting the flow of potable water in said water supply conduits when said first three-way valve is in a second position;

(e) a second three-way valve coupled to said first three-way valve, to said filter and to said further pump for passing anti-freeze from said further pump to said first three-way valve when said second three-way valve is in a first position and for passing anti-freeze from said first three-way valve to said filter means when said second three-way valve is in a second position; and (f) first and second fluid flow shutoff valves, one side of said first shutoff valve coupled in fluid flow relation to said further pump and said second three-way valve and the other side coupled to said anti-freeze reservoir and one side of said second shutoff valve, said other side of said second shutoff valve being coupled to one side of said further pump and to one said of said filter means.

3. Apparatus as set forth in claim 2 including a third three-way valve coupled to a hot water supply conduit and an inlet and outlet port to a hot water heater for bypassing said hot water heater in a first position and for directing water flow through said hot water heater in a second position.

4. Apparatus for filling and removing anti-freeze from the water supply conduits of a water supply system, comprising in combination:

(a) an anti-freeze containing reservoir;

(b) a pump;

(c) a first three-way valve coupled in fluid flow relation to said water supply conduits and said anti-freeze reservoir for bypassing a water source and coupling anti-freeze to said water supply conduits in a first position and bypassing said anti-freeze and permitting the flow of water in said water supply conduits in a second position; and (d) a first four-way valve coupled in fluid flow relation to said water source, to said pump, to said anti-freeze reservoir, to a filter and to a second three-way valve, said first four-way valve operable to pass anti-freeze from said reservoir via said pump to said water supply system in a first position, to return anti-freeze to said reservoir via said filter, said pump and said second three-way valve in a second position and to pass water to said water supply system via said pump in a third position.

5. Apparatus as set forth in claim 4 wherein said second three-way valve passes anti-freeze to said reservoir in a first position and to waste in a second position.

6. Apparatus for filling and removing anti-freeze from the water supply conduits of a water supply system, comprising in combination:

(a) a reservoir for holdng anti-freeze;

(b) a pump;

(c) a first three-way valve coupled in fluid flow relation to said water supply conduits and to said reservoir for bypassing a water source and coupling anti-freeze to said water supply conduits in a first position and bypassing said anti-freeze and permitting the flow of water in said water supply conduits in a second position; and (d) a first four-way valve coupled in fluid flow relation to said water source, said pump, said reservoir, a filter, and a shutoff valve, said first four-way valve operable to pass anti-freeze from said reservoir via said pump to said water supply system in a first position, to return anti-freeze to said reservoir via said filter, said pump and said shutoff valve in a second position and to pass water to said supply system via said pump in a third position.

* * * * *